US005844482A

United States Patent [19]

Guthrie et al.

[11] Patent Number: 5,844,482

[45] Date of Patent: Dec. 1, 1998

[54] TAGGING SYSTEM USING MOTION DETECTOR

[76] Inventors: Warren E. Guthrie, 0N654 Woodlawn, Wheaton, Ill. 60187; Joseph F. Pappadia, Jr., 848 Bennington Dr., Crystal Lake, Ill. 60014

[21] Appl. No.: 859,574

[22] Filed: May 20, 1997

[51] Int. Cl.[6] ..... G08B 13/14

[52] U.S. Cl. ..... 340/568; 340/571; 340/572

[58] Field of Search ..... 340/571, 572, 340/573, 541, 539, 568, 825.36, 687, 689, 825.54

[56] References Cited

U.S. PATENT DOCUMENTS

| | | | |
|---|---|---|---|
| 3,988,724 | 10/1976 | Anderson et al. | 340/539 |
| 4,063,229 | 12/1977 | Welsh et al. | 340/671 |
| 4,656,463 | 4/1987 | Anders et al. | 340/572 |
| 4,686,513 | 8/1987 | Farrar et al. | 340/572 |
| 4,742,357 | 5/1988 | Rackley | 342/457 |
| 4,750,197 | 6/1988 | Denekamp et al. | 340/825.35 |
| 4,818,998 | 4/1989 | Apsell et al. | 342/444 |
| 4,833,456 | 5/1989 | Heller | 340/571 |
| 4,962,369 | 10/1990 | Close | 340/572 |
| 4,980,575 | 12/1990 | Schenkel | 307/121 |
| 5,001,461 | 3/1991 | Vroom et al. | 340/572 |
| 5,014,206 | 5/1991 | Scribner et al. | 364/449 |
| 5,025,246 | 6/1991 | Schenkel | 340/572 |
| 5,327,304 | 7/1994 | Choi | 340/571 |
| 5,387,993 | 2/1995 | Heller et al. | 359/155 |
| 5,537,460 | 7/1996 | Holliday, Jr. et al. | 379/59 |
| 5,610,590 | 3/1997 | Johnson et al. | 340/573 |
| 5,640,143 | 6/1997 | Myron et al. | 340/541 |

*Primary Examiner*—Thomas J. Mullen, Jr.
*Assistant Examiner*—Van T. Trieu
*Attorney, Agent, or Firm*—Stetina Brunda Garred & Brucker

[57] ABSTRACT

The present invention relates generally to a tag monitoring system network used for tracking object movement. The tags utilized in the system incorporate a motion sensor which detects object movement and includes a signal generation circuit adapted to generate a signal when motion is detected. A microcontroller is provided which is in electrical communication with the motion sensor and includes a transmitter activation circuit wherein said microcontroller includes a preprogrammed transmitter sequence which is activated by receipt of a signal from the motion sensor. A radio transmitter is also provided on the tag which is in electrical communication with the microcontroller, and generates radio signals at the direction of the microcontroller.

26 Claims, 2 Drawing Sheets

CONTINUOUS FREQUENT BUSRTS

FREQUENT BUSRTS AT START AND END OF MOVEMENT

FREQUENT BUSRTS AT START AND END OF MOVEMENT AND PERIODICAL INTERMEDIATE BURSTS

FREQUENT BURSTS AT THE START OF MOVEMENT ONLY

TAGGING SYSTEM USING MOTION DETECTOR

FIELD OF THE INVENTION

The present invention relates generally to a tag monitoring system network used for tracking object movement. The tags utilized in the system incorporate a bump sensor which detects movement and a transmitter that relays movement information to a central location. The method of the present invention includes several transmitter protocol schemes that broadcast information related to object movement dependent on the type of object being tracked.

BACKGROUND OF THE INVENTION

Methods and systems for electronic surveillance and tracking of articles are generally known. Such systems include passive article attached devices, wherein the attached devices do not include power sources. In such a system determination of the article location relates to the passage of the device through a specific monitored zone. Such systems are limited by the number of zones to be monitored and are generally only useful in confined areas.

Other systems include active devices which have an on board power source and which can transmit information to a receiver. Active article or tagged systems are typical in theft deterrent devices. In such devices, a motion detector and transmitter are set on board an object. When the object is moved in such a manner to be detected by the motion sensor, a transmitter activates a signal broadcast to a receiver. The receiver is typically only capable of broadcasting a single transmitter signal. Such device may be dependent on an event other than motion to activate a signal, such as unauthorized break-in of a vehicle. Further, such devices are only capable of signaling a single type of movement and the device is incapable of discerning the type of movement occurring and transmitting the nature of the movement to the receiver. Further, such systems are typically only capable of monitoring a single event, without tracking and continuous monitoring capabilities.

SUMMARY OF THE INVENTION

In accordance with the present invention there is provided a system for monitoring the movement of a tagged object. The system includes at least one overall system receiver which receives radio input signals from the tags used in the system. Each tag in the system is releasably engagable to an object that is desired to be tracked.

The tag which is used in accordance with the present invention incorporates a motion sensor which detects object movement and includes a signal generation circuit adapted to generate a signal when motion is detected. A microcontroller is provided which is in electrical communication with the motion sensor and includes a transmitter activation circuit wherein said microcontroller includes a preprogrammed transmitter sequence which is activated by receipt of a signal from the motion sensor. A radio transmitter is also provided on the tag which is in electrical communication with the microcontroller, and generates radio signals at the direction of the microcontroller.

The transmitted signal is received by a remote receiver where the signal is processed and an appropriate action is taken.

Thus, according to the preferred embodiment of the present invention, each radio tag transmitter comprises an oscillator.

Further, according to the preferred embodiment of the present invention, a timing circuit effects transmission of the normal radio signals at either a random interval or a pseudo-random interval, so as to mitigate communications contention and so as to conserve power. Communications contention is mitigated since the use of such a random or pseudo-random transmission interval substantially reduces the likelihood that two radio tag transmitters will transmit to a single remote receiver at the same instant. Indeed, if two radio tag transmitters were to transmit to the same remote receiver at the same instant, one or both such transmissions would be ignored and it is extremely unlikely that subsequent retransmissions of the two radio tag transmitters would occur at exactly the same instant again, since the time intervals between transmissions are either random or pseudo-random in nature.

The radio tag transmitter preferably, but not necessarily, comprises a circuit for transmitting a direct sequence spread spectrum radio signal. As those skilled in the art will appreciate, it is possible to maximize the effective range of such a transmitter, without requiring FCC licensing, via the use of direct sequence spread spectrum modulation.

The microcontroller preferably includes a series of preprogrammed broadcast schemes which allow the tag to be utilized in a variety of systems. A first scheme provides for a series of frequent bursts that commence upon the start of detected movement and continuously transmits signals until an indication that there is a cessation of movement is received.

A second scheme produces an initial series of transmission bursts for a short time following the detection of initial movement, and a second series of frequent transmission bursts for a short time following detection of cessation of movement of the object.

A third scheme provides an initial series of frequent bursts for a short period of time following an indication of initial movement. A series of periodical bursts are thereafter transmitted until the cessation of movement is detected wherein a final series of bursts are transmitted for a short period of time.

A further scheme provides an initial series of frequent bursts for a short time following a detection of initial movement, a series of random bursts thereafter until detection of cessation of movement wherein a final series of bursts are transmitted for a short time.

A further scheme provides a series of frequent bursts for a short time following detection of initial movement. There are no additional transmissions following in the initial movement.

A further scheme provides transmission of a series of frequent bursts for a short time following the detection of ceasing of object movement. The frequent bursts at the end of the movement is the only transmission completed under such a scheme.

DETAILED DESCRIPTION OF THE PREFERRED EMBODIMENT

The detailed description as set forth below in connection with the appended drawings is intended as a description of the presently preferred embodiments of the present invention, and are not intended to represent the only form in which the present invention may be constructed or utilized. The description sets forth functions and sequence of steps for constructing and operating the invention in connection with the illustrated embodiments. It is understood, however, the same or equivalent functions and sequences may be accomplished by different embodiments and that they are also intended to be encompassed within the spirit and scope of this invention.

Figure 1:
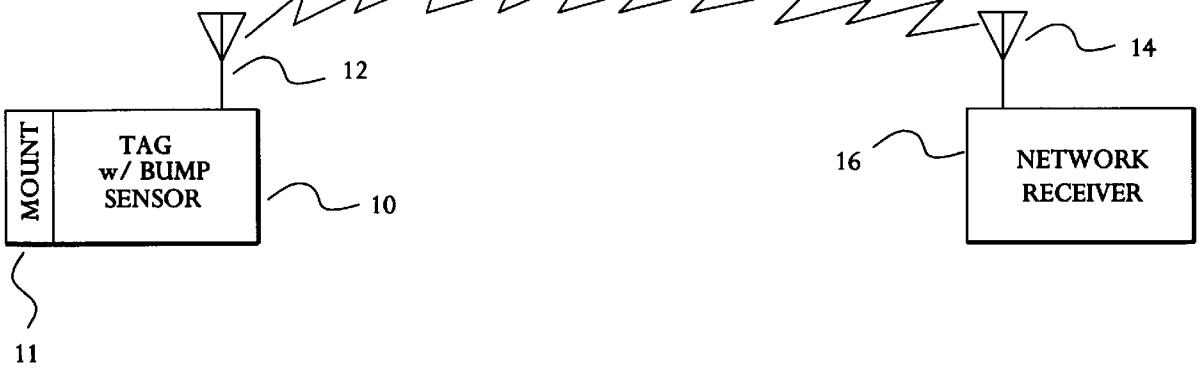
FIG. 1 is a block diagram of the overall components of the system for monitoring movement of a tagged object of the present invention showing an exemplary tag transmitting to a network receiver.

Referring particularly to FIG. 1, there is shown the tagged monitoring system network of the present invention used for tracking object movement. In FIG. 1 a tag 10 is shown, and such tag 10 is adapted to be releasably engagable, via mount 11, with an object desired to be tracked. The tag 10 includes a bump sensor or movement detector which operates to create a signal to be broadcast over the tag antenna 12 for receipt by a network antenna 14 to be processed by the network system 16. It is contemplated by the present invention that a series of network antennas would be strategically located about an area in which the objects which are tagged are to be monitored. In the case of a very limited area, a single network antenna may only be required. However, if the monitoring area could be over a large region, a series of network antennas may be required. It is contemplated by the present invention that the tagged monitoring system network would be used in association with asset and inventory tags. Different types of information could be broadcast from the tag antenna 12 depending on the nature and use of the inventory tag system. In application, the inventory tagged system may be used to track cargo moved by truck, ship, rail, air and other means of transportation. The system may also be utilized to determine the occurrence of a seismic event and could be used to trigger emergency alarms or other procedures. Further, the inventory tagging system may be used to determine movement of precious and valuable objects for security and locating purposes. Such tag system may be used in a machine environment to determine when machinery stops operating or begins operating. The system may also be utilized to track people or objects within a certain area. Additional applications such as use in a seismic detector for metering and monitoring applications is also contemplated. In this regard, the system of preferred embodiment may be used in a number of applications when it is important to know when and where an object/individual is moving, and to monitor that movement.

Figure 2:
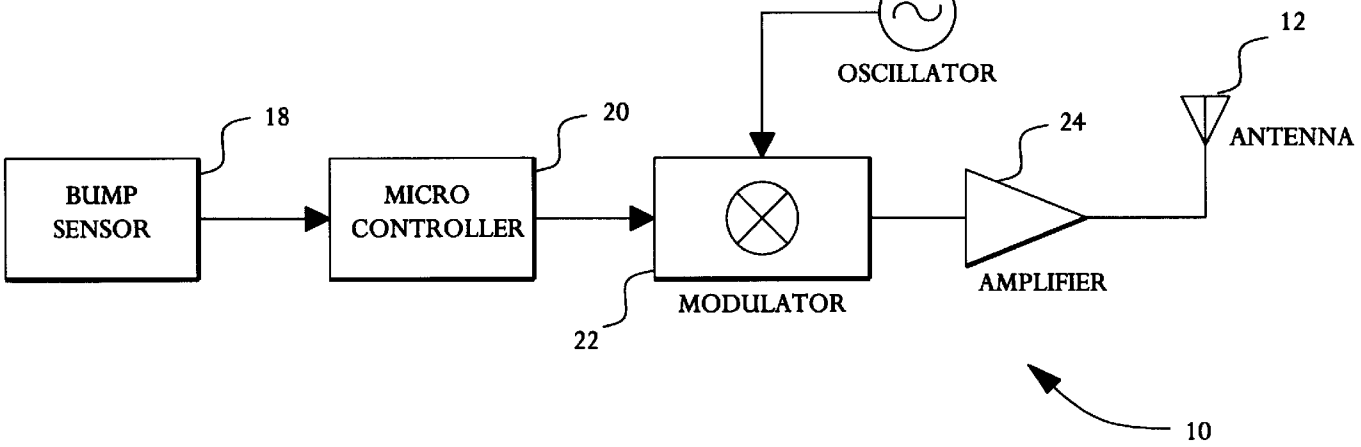
FIG. 2 is a block diagram of the components of the tag which is utilized in the system for monitoring of a tagged object of the present invention.

Referring specifically to FIG. 2, there is shown the tag 10 and the component parts thereto. A bump sensor 18 is shown in electrical communication with a microcontroller 20. The bump sensor 18 is essentially a motion detector which, when attached to the object desired to be tracked will be able to generate a signal in response to movement of the object. Examples of suitable bump sensors include mercury tilt switches, accelerometers, velocity sensors, displacement sensors, rotation sensors, etc. Those skilled in the art will appreciate that various other types of bump sensors are likewise suitable. A signal from the bump sensor 18 is received by the microcontroller 20, and based upon the information stored on the microcontroller, in certain situations, the microcontroller will initiate the modulator 22 to generate a signal which is amplified by the amplifier 24 and transmitted over the tag antenna 12. The oscillator 26 regulates the frequency of the tag antenna 12 output.

In operation, the bump sensor 18 detects movement of the object and generates a signal to be received by the microcontroller 20. The microcontroller 20 therefore initiates a transmission sequence to be broadcast over the antenna 12. It is additionally contemplated by the present invention that the microcontroller 20 could additionally serve other functions such as triggering an alarm or other related functions. The microcontroller activates the circuity necessary to transmit signals over the tag antenna 12 namely the modulator 22, amplifier 24 and oscillator 26. The duration and the number of transmission bursts from the antenna 12 is preprogrammed into the microcontroller which initiates the transmission circuity. Also, the bump sensor 18 may be able to send a signal or terminate a signal to the microcontroller 20 when the motion of the object has ceased.

The tag transmitter which comprises the modulator 22, amplifier 24, oscillator 26 and antenna 12 transmits radio signals at a frequency with an unknown center frequency within a known frequency band. Accordingly, each time the tag transmitter transmits a radio signal, it generates the signal at a random frequency which is then received by the system receiver 16. The system receiver 16 identifies the center frequency of the radio signal, tunes to the center frequency of that radio signal and gathers information from the tag based upon the signal. Several types of receiver devices in the system receiver 16 may be utilized such as a scanner or other similar receiver which is capable of receiving a number of different frequencies within a known band.

Figure 3A:
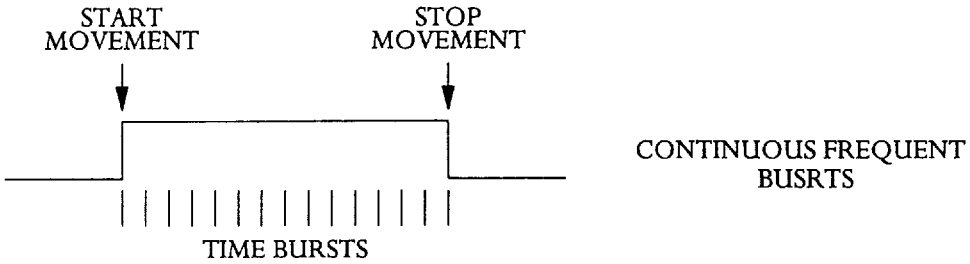
FIG. 3*a* is a graphical representation of broadcast of radio bursts where those bursts are continuous.

Referring specifically to FIGS. 3*a*–3*e,* there is shown a plurality of possible transmission schemes from the tag in order to transmit information to the tag monitoring system. Referring specifically to FIG. 3*a,* a timeline is shown indicating start movement detected by the bump sensor 18 and stop movement by the same bump sensor 18. In the scheme pictured in FIG. 3*a,* the microcontroller 20 receives a start movement signal, and based upon the scheme preprogrammed into the microcontroller 20, initiates the transmitter circuity to transmit continuous frequent bursts from the antenna 12 to be received by the network system 16. At the stop movement signal (or lack of movement signal) the microcontroller ceases further transmission of the frequent bursts. In the transmission sequence of FIG. 3*a,* such scheme would be appropriate in instances where it is important to always know the state of the tag 10. In the FIG. 3*a* scheme the continuous bursts require additional power which may decrease battery life. The scheme in FIG. 3*a* is useful to continuously track the movement of certain objects and is also appropriate when the tracking of the object must be extremely accurate.

Figure 3B:
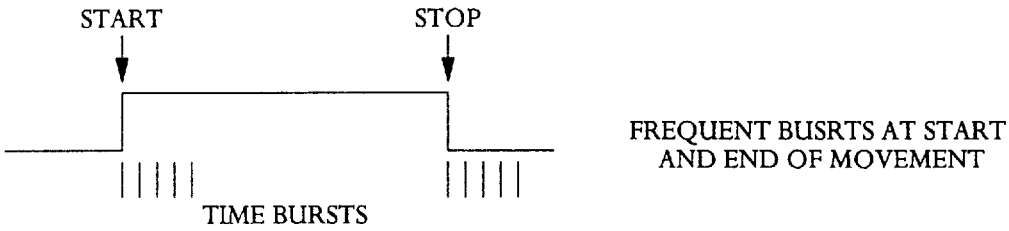
FIG. 3*b* is a graphical representation of broadcast of radio bursts where frequent bursts are only at the start and end of the movement.

Referring specifically to FIG. 3*b,* there is shown a further scheme which contemplates the use of frequent bursts at the start and end of movement of the object. First, the bump sensor 18 detects movement of the object and sends a signal to the microcontroller 20. The microcontroller, based upon preprogrammed information, initiates the transmission circuit to broadcast a series of frequent bursts for a short period of time at the beginning of the movement to notify the system network 16 that movement has begun. A second series of bursts would not initiate until the bump sensor 18 determines that all movement is stopped. Again, based upon preprogrammed information in the microcontroller 20, a second series of frequent bursts notifies the network 16 that the object has ceased movement. The scheme described in FIG. 3*b* notifies the system 16 when the object starts and stops moving and is advantageous for power consumption savings. The scheme described in FIG. 3*b* would be particularly suited when tracking shipments by truck, ship, rail, sea and other modes of transportation where the bump sensor 18 would be tripped continuously for long periods of time.

Figure 3C:
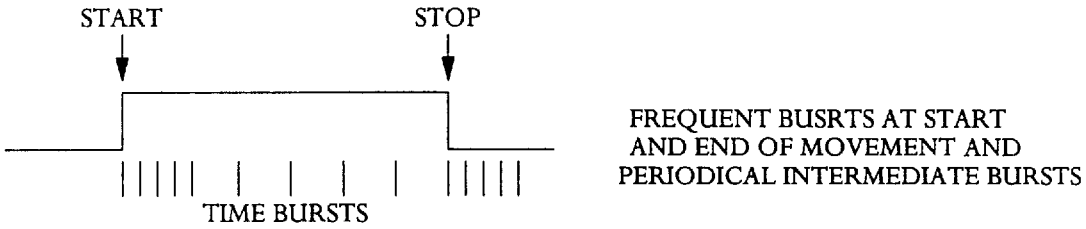
FIG. 3*c* is a graphical representation of broadcast of radio bursts where frequent bursts are at the start and end of the movement and include periodical intermediate bursts.

Referring specifically to FIG. 3*c* there is shown a further scenario for transmitting signals from the tag 10 to the system network 16. In the scheme of FIG. 3*c* a series of frequent bursts are made at the start and end of the object's movement. In between the start and end of the object's movement periodical or random bursts are transmitted. In this regard, at the initiation of movement of the object, which is detected by the bump sensor 18, a signal is forwarded to the microcontroller 20. The microcontroller 20, based upon preprogrammed information, initiates the transmitter circuity to transmit a first series of frequent bursts for a short period of time following the initial movement. Thereafter, random or periodical bursts are transmitted until such time as the bump sensor 18 detects cessation of movement of the object. At that time, the microcontroller initiates a final series of frequent bursts for a short period of time immediately following the ceased activity. The scheme as shown in FIG. 3*c* is similar to the scheme as shown in FIG. 3*b,* however, the scheme of FIG. 3*c* includes the periodical or random bursts. This will allow periodic monitoring by the system 16 to determine location of the object. FIG. 3*c* is advantageous in certain situations over the scheme as shown in FIG. 3*a* as it reduces power consumption since the intermediate bursts are random or periodical. The random bursts allow continued monitoring during movement. The scheme of FIG. 3*c,* however, is not as accurate in object tracking as the scheme of 3*a*.

Figure 3D:
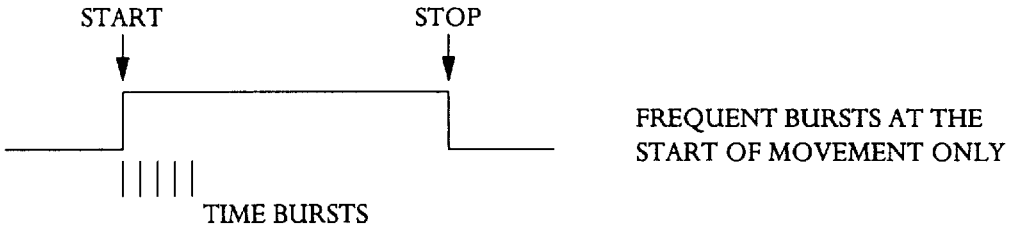
FIG. 3*d* is a graphical representation of broadcast of radio bursts where frequent bursts are at the start of movement only.

Referring to FIG. 3*d,* there is shown another scenario wherein a series of frequent burst occurs only at the start of the movement of the object. In this regard, upon movement of the object, the bump sensor 18 senses the movement, and forwards a signal to the microcontroller 20. The microcontroller 20, based upon preprogrammed information, transmit a series of frequent bursts, short in time duration, following the movement to notify the system 16 that movement has started. No further bursts are required under the scheme of FIG. 3*d*. The scheme of FIG. 3*d* is similar to that of 3*b* except that there is no burst at the termination of movement.

Figure 3E:
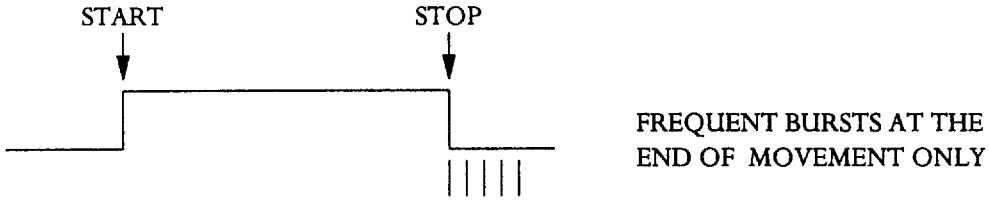
FIG. 3*e* is a graphical representation of broadcast of radio bursts where frequent bursts are at the end of movement only.

Referring particularly to FIG. 3*e,* there is shown a further scheme wherein the bump sensor 18 only sends a signal to the microcontroller 20 at cessation of the movement of the object. Upon cessation of movement, the bump sensor 18 forwards a signal to the microcontroller 20, and based upon the preprogrammed information, the microcontroller 20 directs the transmission circuit to transmit a series of bursts short in time duration for receipt by the system 16. Thus, the tag transmits only after the object has stopped moving. The scheme of FIG. 3*e* is particularly suited in use of monitoring machine operation as it would be a preferred method of monitoring whether machinery has stopped operating.

Additional modifications and improvements of the present invention may also be apparent to those skilled in the art. Thus, a particular combination of parts described and illustrated herein is intended to represent only certain embodiments of the present invention, and is not intended to serve as limitations of alternative devices within the spirit and scope of the invention.

What is claimed is:

1. A system for monitoring movement of an object comprising:

(a) a system receiver for receiving radio signals, the system receiver configured to receive a radio signal of an unknown center frequency within a known frequency band;

(b) at least one system tag engagable with an object comprising;

(1) a motion sensor for detecting object movement including a signal generation circuit adapted to generate a signal upon detected object movement;

(2) a microcontroller in electrical communication with said motion sensor including a transmitter activation circuit for communicating a preprogrammed transmitter sequence stored in said microcontroller upon receipt by said microcontroller of a signal from the motion sensor; and (3) a radio transmitter in electrical communication with said microcontroller for generating a transmission sequence of radio signals having an unknown center frequency within a known frequency band in response to communication of said preprogrammed transmitter sequence from the microcontroller wherein said transmission sequence of radio signals comprise an initial series of frequent signal bursts transmitted for a short time following initial detected object movement, an intermediate series of periodical signal bursts transmitted following the initial signal bursts, and a final series of signal bursts transmitted to a short time following detection of cessation of movement of the object.

2. The system for monitoring movement of an object of claim 1 wherein said motion sensor is a mercury tilt switch.

3. The system for monitoring movement of an object of claim 1 wherein said motion sensor is an accelerometer.

4. The system for monitoring movement of an object of claim 1 wherein said motion sensor is a velocity sensor.

5. The system for monitoring movement of an object of claim 1 wherein said motion sensor is a displacement sensor.

6. The system for monitoring movement of an object of claim 1 wherein said motion sensor is a rotation sensor.

7. A system for monitoring movement of an object comprising:

(a) a system receiver for receiving radio signals, the system receiver configured to receive a radio signal of an unknown center frequency within a known frequency band;

(b) at least one system tag engagable with an object comprising;

(1) a motion sensor for detecting object movement including a signal generation circuit adapted to generate a signal upon detected object movement;

(2) a microcontroller in electrical communication with said motion sensor including a transmitter activation circuit for communicating a preprogrammed transmitter sequence stored in said microcontroller upon receipt by said microcontroller of a signal from the motion sensor; and (3) a radio transmitter in electrical communication with said microcontroller for generating a transmission sequence of radio signals having an unknown center frequency within a known frequency band in response to communication of said preprogrammed transmission sequence from the microcontroller wherein said transmission sequence of said radio signals comprises an initial series of frequent signal bursts transmitted for a short time following initial detected object movement, an intermediate series of random signal bursts transmitted following the initial signal bursts, and a final series of signal bursts transmitted for a short time following detection of cessation of movement of the object.

8. The system for monitoring movement of an object of claim 7 wherein said motion sensor is a mercury tilt switch.

9. The system for monitoring movement of an object of claim 7 wherein said motion sensor is an accelerometer.

10. The system for monitoring movement of an object of claim 7 wherein said motion sensor is a velocity sensor.

11. The system for monitoring movement of an object of claim 7 wherein said motion sensor is a displacement sensor.

12. The system for monitoring movement of an object of claim 7 wherein said motion sensor is a rotation sensor.

13. A system for monitoring movement of an object comprising:

(a) a system receiver for receiving radio signals from system radio transmitters;

(b) at least one system tag engagable with an object comprising;

(1) a motion sensor for detecting object movement including a signal generation circuit adapted to generate a signal upon detected object movement;

(2) a microcontroller in electrical communication with said motion sensor including a transmitter activation circuit for communicating a preprogrammed transmitter sequence stored in said microcontroller upon receipt by said microcontroller of a signal from the motion sensor; and (3) a system radio transmitter in electrical communication with said microcontroller for generating a transmission sequence of radio signals in response to communication of said preprogrammed transmission sequence from the microcontroller wherein said transmission sequence of said radio signals comprises an initial series of frequent signal bursts transmitted for a short time following initial detected object movement, an intermediate series of periodic signal bursts transmitted following the initial signal bursts, and a final series of signal bursts transmitted for a short time following detection of cessation of movement of the object.

14. The system for monitoring movement of an object of claim 13 wherein said motion sensor is a mercury tilt switch.

15. The system for monitoring movement of an object of claim 13 wherein said motion sensor is an accelerometer.

16. The system for monitoring movement of an object of claim 13 wherein said motion sensor is a velocity sensor.

17. The system for monitoring movement of an object of claim 13 wherein said motion sensor is a displacement sensor.

18. The system for monitoring movement of an object of claim 13 wherein said motion sensor is a rotation sensor.

19. A system for monitoring movement of an object comprising:

(a) a system receiver for receiving radio signals from system radio transmitters;

(b) at least one system tag engagable with an object comprising;

(1) a motion sensor for detecting object movement including a signal generation circuit adapted to generate a signal upon detected object movement;

(2) a microcontroller in electrical communication with said motion sensor including a transmitter activation circuit for communicating a preprogrammed transmitter sequence stored in said microcontroller upon receipt by said microcontroller of a signal from the motion sensor; and (3) a system radio transmitter in electrical communication with said microcontroller for generating a transmission sequence of radio signals in response to communication of said preprogrammed transmission sequence from the microcontroller wherein said transmission sequence of said radio signal comprises an initial series of frequent signal bursts transmitted for a short time following initial object movement, an intermediate series of random signal bursts transmitted following the initial bursts, and a final series of bursts for a short time following detection of cessation of movement of the object.

20. The system for monitoring movement of an object of claim 19 wherein said motion sensor is a mercury tilt switch.

21. The system for monitoring movement of an object of claim 19 wherein said motion sensor is an accelerometer.

22. The system for monitoring movement of an object of claim 19 wherein said motion sensor is a velocity sensor.

23. The system for monitoring movement of an object of claim 19 wherein said motion sensor is a displacement sensor.

24. The system for monitoring movement of an object of claim 19 wherein said motion sensor is a rotation sensor.

25. A method for monitoring movement of an object comprising the steps of:

(a) detecting initial movement of the object;

(b) transmitting radio signals in an initial series of frequent signal bursts in response to detection of movement of the object;

(c) detecting continued movement of an object following said initial movement of the object;

(d) transmitting radio signals in an intermediate series of periodical signal bursts in response to continued movement of the object;

(e) detecting cessation of movement of the object following said continued movement of an object; and (f) transmitting radio signals in a final series of signal bursts for a short time in response to detection of cessation of movement of the object.

26. A method for monitoring movement of an object comprising the steps of:

(a) detecting initial movement of the object;

(b) transmitting radio signals in an initial series of frequent signal bursts in response to detection of movement of the object;

(c) detecting continued movement of an object following said initial movement of the object;

(d) transmitting radio signals in an intermediate series of random signal bursts during continued movement of the object;

(e) detecting cessation of movement of an object following said continued movement of an object; and (f) transmitting radio signals in a final series of signal bursts for a short time in response to detection of cessation of movement of the object.

* * * * *